United States Patent [19]

Rosenberg et al.

[11] Patent Number: 4,564,303

[45] Date of Patent: Jan. 14, 1986

[54] NONTILTABLE, STRAIGHT LINE PATH RIBBON CARTRIDGE SHIFTING MEANS FOR MULTICOLOR RIBBON INCLUDING MICR INK

[75] Inventors: Michael J. Rosenberg, 3327 Euclid Heights Blvd., Cleveland Hts., Ohio 44118; Alfred C. Erpel, Doylestown, Pa.

[73] Assignee: Michael J. Rosenberg, Cleveland Heights, Ohio

[21] Appl. No.: 502,671

[22] Filed: Jun. 9, 1983

[51] Int. Cl.[4] ..... B41J 32/00

[52] U.S. Cl. ..... 400/208; 400/105; 400/206.3; 400/212; 400/214; 400/225; 400/227.2; 400/229; 400/235.1

[58] Field of Search ..... 400/105, 106, 107, 194, 400/195, 196, 196.1, 206, 206.1, 206.3, 206.4, 207, 208, 208.1, 212, 214, 225, 227.2, 229, 235.1, 240.4, 569

[56] References Cited

U.S. PATENT DOCUMENTS

| | | | |
|---|---|---|---|
| 3,595,362 | 7/1971 | Wolowitz | 400/216.2 |
| 3,618,738 | 11/1971 | Boyatt et al. | 400/569 X |
| 3,645,371 | 2/1972 | Jovis | 400/212 X |
| 3,904,017 | 9/1975 | Frechette | 400/208 X |
| 3,927,746 | 12/1975 | Wolowitz | 400/229 X |
| 3,967,790 | 7/1976 | Hess | 400/196 X |
| 3,993,182 | 11/1976 | Steinke | 400/235.1 X |
| 3,995,731 | 12/1976 | Miller et al. | 400/195 |
| 4,034,935 | 7/1977 | Plaza et al. | 400/208 X |
| 4,302,118 | 11/1981 | Schaefer | 400/208 |
| 4,329,072 | 5/1982 | Kacmarcik | 400/208 |
| 4,337,001 | 6/1982 | Cappotto | 400/208 |
| 4,347,007 | 8/1982 | Schaefer | 400/208 |
| 4,353,657 | 10/1982 | Schaefer | 400/208 |
| 4,407,595 | 10/1983 | Gershnow | 400/212 |

FOREIGN PATENT DOCUMENTS

| | | | |
|---|---|---|---|
| 0059923 | 9/1982 | European Pat. Off. | 400/208 |
| 1611468 | 5/1979 | Fed. Rep. of Germany | 400/208 |
| 2824454 | 12/1979 | Fed. Rep. of Germany | 400/208 |

OTHER PUBLICATIONS

IBM Technical Disclosure Bulletin, "Self-Aligning Ribbon and Tape Drive," Lingle, vol. 26, No. 3A, Aug. 1983, pp. 1157–1158.

*Primary Examiner*—Ernest T. Wright, Jr.
*Attorney, Agent, or Firm*—Renner, Otto, Boisselle & Lyon

[57] ABSTRACT

A printer for use with a data processor and a ribbon cartridge for use in the same are disclosed. The cartridge has at least two separate ribbon supplies which may differ in the type of ink on the ribbon (MICR vs. ordinary) and/or in color of ink or otherwise. A mechanism moves the cartridge along a straight line path to index selectively an active portion of each of the ribbons to a position aligned between a printhead and a platen for printing through the selected ribbon. A ribbon drive mechanism drives at least one of the ribbon supplies only when that ribbon supply has been selectively indexed to be printed through. In one embodiment a Magnetic Ink Character Recognition ribbon supply is driven between take-up and supply reels only when it is indexed for printing, while a multi-strike ribbon with ordinary ink is driven continuously. In another embodiment only one of two or more ribbon supplies is driven at one time. In both embodiments the straight line movement of the cartridge between indexed positions engages and disengages the drive to the various ribbon supplies by movement of the cartridge along the axis of a ribbon drive shaft.

9 Claims, 13 Drawing Figures

NONTILTABLE, STRAIGHT LINE PATH RIBBON CARTRIDGE SHIFTING MEANS FOR MULTICOLOR RIBBON INCLUDING MICR INK

BACKGROUND OF THE INVENTION

The present invention relates to printers, especially those for data processing equipment, and particularly to a dot matrix printer which prints characters in either of two or more inks and to a cartridge having a plurality of ribbons each with a different ink suitable for use in such a printer. The invention also relates to improvements for printers to enable facile use of multiple ribbons. The invention also relates to a method of printing materials, such as checks, requiring different inks, such as standard and MICR type inks.

In the past, printers used with data processing equipment were capable of printing with only a single ribbon at one time. For some printing jobs this has proven inconvenient. For example, when printing payroll checks the bulk of the information printed on the check may be printed with ordinary ink and any normal typeface. The name of the issuer, the issuer's bank, the date and the payee may be so printed. However, checks also must include certain information printed in a special typeface with magnetic (MICR-Magnetic Ink Character Recognition) ink. Such information includes a bank identification number, a check number and an amount.

MICR ink is substantially more expensive than ordinary ink. Additionally, MICR inked ribbons for high speed printers are single strike ribbons, which, unlike the ribbon used with ordinary ink, e.g. fabric ribbons, may not be circulated past the printhead more than one time. The result is that MICR ribbon cartridges must be replaced after many fewer characters have been printed than comparable ordinary ribbon cartridges and at a greater cost. Therefore, it has not proven economical to print entire checks with MICR ink.

The past practice when printing payroll checks has been to preprint the bank identification number and check number in MICR ink and typeface on the check blanks; or this process may involve using a separate printer, e.g. a daisy wheel printer or MICR encoder, either before or after the non-MICR information has been printed on the checks, but in any event in a separate operation and normally without amount information. In a separate printing operation, or in the same operation but with different ink, the issuer's name and bank are also printed on the check blank. Then the check blank is run through a printer which may be controlled by a data processor to print in ordinary ink the date, the payee's name, and the amount of the check. The first bank to receive the check then must read the amount of the check and add to the check blank the dollar amount in MICR characters and ink.

Another prior process for placing MICR information, e.g. relating to bank identification number, account number, and sequence number, may be carried out using a separate MICR encoding machine. Moreover, heretofore a typical check is not encoded with amount information until it reaches the first bank for clearing, payment, etc.; at such bank an MICR encoding (proof) machine is used to apply such amount information to enable subsequent automatic reading and/or handling of the check.

The process of issuing and processing checks such as payroll checks would be greatly simplified if a single printer could print all the data on the front of the check, using either ordinary or MICR inks and typefaces as required. Likewise the processes of encoding MICR information on documents other than checks and of printing multiple information on such documents would be greatly simplified, according to the present invention, e.g. by using only a single prior and multiple ribbon capability thereof.

SUMMARY OF THE INVENTION

The present invention provides such a printer improvement and, in particular, a printer for use in conjunction with a data processor. The printer can print selectively with either of two or more ribbons. The invention also includes a ribbon cartridge for use in such a printer. The printer includes a conventional dot matrix printhead and a rotatable platen. The printhead is mounted on a carriage assembly for reciprocating movement along a path parallel to the axis of the platen. The carriage assembly also carries a ribbon cartridge having a supply of two or more different ribbons, an active portion of each of the ribbons being positionable between the printhead and the platen for printing on a web or other sheet material.

The ribbon cartridge includes a plurality of different ribbon supplies driven by a common drive motor. In one embodiment there are two ribbon supplies, one a supply of multi-strike ribbon inked with ordinary ink and the other a supply of single-strike ribbon inked with MICR ink. The multi-strike ribbon is randomly stuffed in a cavity in the lower portion of the cartridge, and the active portion thereof is pulled past the printhead by a pair of opposed drive wheels frictionally engaging opposite sides of the ribbon. The single-strike MICR ribbon is supplid wound on a supply reel and is wound onto a separate take-up reel located between the supply reel and the random storage cavity. The MICR ribbon is pulled along a path with an active portion immediately above the active portion of the multi-strike ribbon. An opposed pair of drive wheels pulls the MICR ribbon. One of the MICR drive wheels is coaxial with one of the multi-strike ribbon drive wheels.

The ribbon drive is arranged to drive selectively at least one of the ribbon supplies. In practice, the MICR ribbon is not driven when the printhead is aligned with the active portion of the multi-strike ribbon. Instead, the MICR ribbon is driven only when the printhead is aligned with the active portion of the MICR ribbon to print magnetically readable characters. The selective driving of the MICR ribbon prolongs the time between ribbon cartridge changes.

A mechanism is provided for shifting the cartridge between a first operating position in which the active portion of one of the ribbons is aligned between the printhead and the platen and a second operating position in which the active portion of the other ribbon is so aligned. In cartridges having three or more ribbons, a corresponding number of positions are provided. The shifting mechanism provides for straight line movement, as opposed to a rocking or tilting movement, of the cartridge along a straight line path normal to a plane containing the platen axis and in the common plane of the active portions of the ribbons. The straight line movement facilitates the selective drive of the MICR ribbon and accurate ribbon alignment with respect to the printhead and platen. Specifically, the drive wheel for the multi-strike ribbon is driven by a fluted shaft which extends through the center thereof. The multi-strike ribbon drive wheel is axially slidable along the shaft as the cartridge shifts between operating positions. In one of the operating positions the shaft engages and drives the drive wheel for the MICR ribbon as well as the multi-strike ribbon drive wheel. In the other operating position, the shaft is free of contact with the MICR ribbon drive wheel and so does not drive it. In this way movement of the cartridge between operating positions automatically engages and disengages drive to the more expensive and non-reusable MICR ribbon.

The ribbon cartridge travels with the printhead. This minimizes ribbon, particularly the MICR ribbon, used during operation of the printer.

The arrangement of the components is also designed to minimize the mass which must move vertically when shifting between one operating position and the other and to minimize the mass that reciprocates laterally with the carriage assembly along the length of the platen as each line is printed. The ribbons are both driven by a single electric motor which is connected to the reciprocating carriage. This motor does not move vertically when the cartridge is shifted between operating postions. Instead, the cartridge moves up and down sliding on the ribbon drive shaft which is driven by the electric motor. This not only selectively engages and disengages the MICR drive wheel as discussed above, but also allows reduced weight by using only a single motor and promotes faster shifting between operating positions because the motor itself does not move.

The cartridge is shifted between operating positions by a solenoid which is remote from the cartridge. The solenoid is fixed to the printer frame and, through a crank arm, rotates a square shaft. The square shaft in turn operates a second crank arm which is slidable along the shaft as the carriage moves. The cartridge is mounted on linear bearings in the carriage and moves up and down in a straight line path when the second crank arm is rotated by actuation of the solenoid. This arrangement reduces the mass which reciprocates laterally, thereby speeding printing and reducing power consumption, vibration and wear.

A method in accordance with the present invention effects selective printing of different portions of the medium with MICR ink and with non-MICR ink. The method includes aligning a ribbon carrying non-MICR ink with respect to a printhead and with respect to such medium and printing selected portions of such medium with ink from such first ribbon. As desired, the first ribbon is moved out from such alignment and a second ribbon containing MICR ink is aligned with respect to such printhead and such medium and selected other portions of such medium are printed using ink therefrom. Preferably such medium is a check.

Accordingly it is an object of the invention to enable a printer to shift between printing with any of two or more ribbons.

It is a further object of the invention to provide a ribbon cartridge with a plurality of ribbon supplies, and particularly with one of the ribbon supplies being MICR ribbon.

It is a further object of the invention to provide a printer which can shift between printing with any of two or more ribbons.

It is a further object of the invention to provide a ribbon cartridge in which ribbon drive wheels for each of a plurality of ribbon supplies are coaxially aligned.

It is a further object of the invention selectively to drive one or more of the ribbon supplies of a printer depending on which ribbon is shifted into a printing position.

It is a further object of the invention selectively to shift a ribbon into a printing position by moving a ribbon cartridge assembly along a straight line path normal to a plane containing the platen axis and in a plane common to the active portions of the ribbons.

It is a further object of the invention to minimize inertia in a printer shift mechanism.

It is a further object selectively to print different portions of the medium in MICR ink and in non-MICR ink, especially with such medium being a check.

The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be carried out.

DESCRIPTION OF PREFERRED EMBODIMENTS

Figure 1:
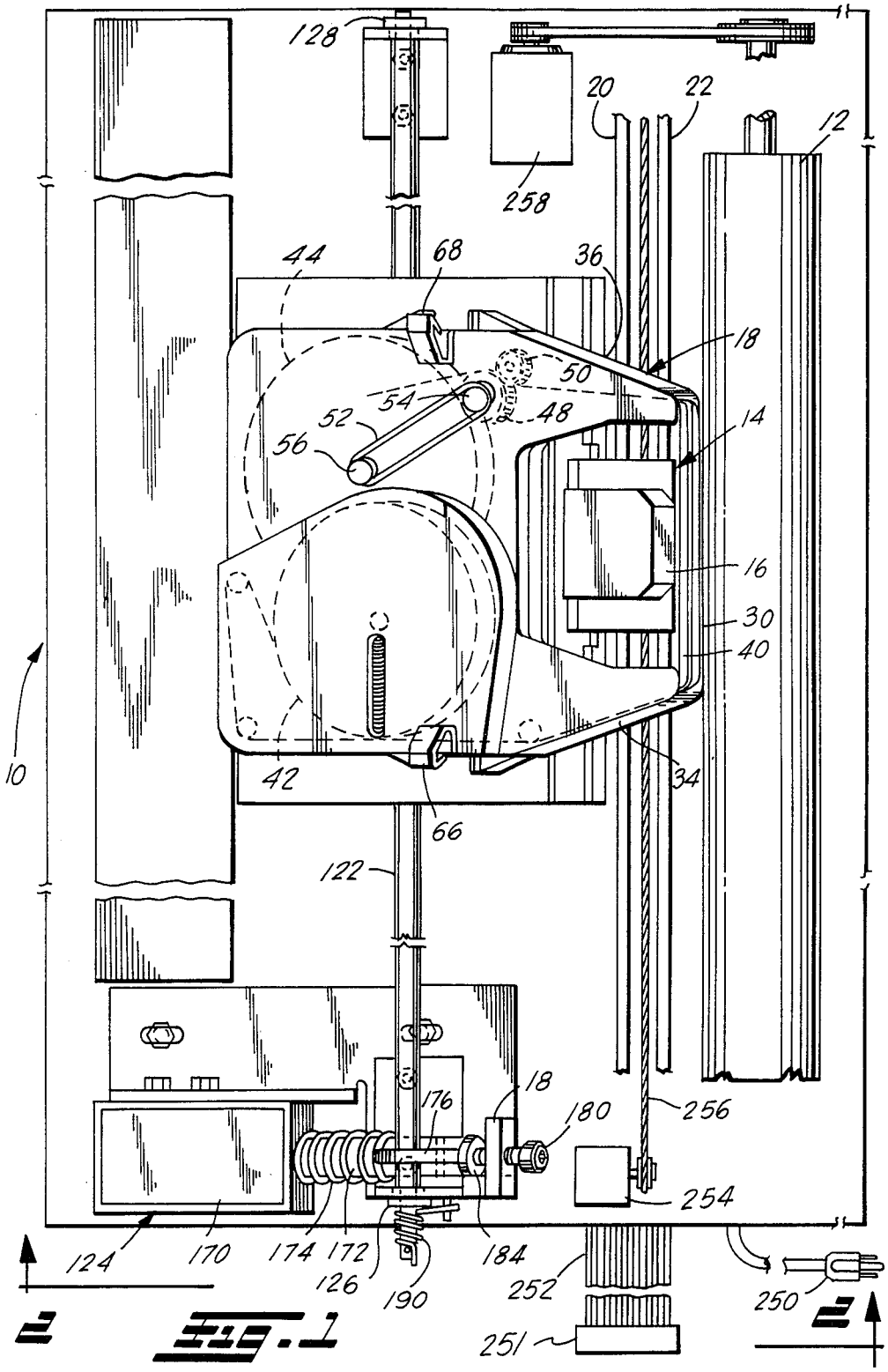
FIG. 1 is a plan view of a printer and cartridge constructed in accordance with the present invention.

FIG. 1 illustrates a printer 10 constructed in accordance with the present invention for use with a data processor. In use, a web 11 (FIG. 2, not shown in FIG. 1 for clarity) such as blank payroll checks is fed around platen 12 and the printer 10 prints thereon. A carriage assembly 14 includes a printhead 16 and a ribbon cartridge assembly 18. The carriage assembly 14 moves along rails 20 and 22 parallel to the axis of the platen 12 to print each line on the web 11. When a line of print is completed, the platen 12 is rotated to advance the web 11 and a succeeding line is printed. The printer 10 is a high speed printer, for example, capable of printing about 600 characters per second, or about 250 lines per minute, at least where characters are formed by a single pass or traverse of the printhead 16. An exemplary printer is one sold by Florida Data Inc.

Printing commonly occurs while the carriage assembly 14 is moving in either direction. When using a dot matrix printhead 16 to print some typefaces, it may require more than a single pass of the printhead 16 to print an entire line. For example, two passes may be required to form MICR (magnetic ink character recognition) characters with a dot matrix printhead 16. Other types of printheads, such as the so-called daisy wheel printheads, do not require more than a single pass, but these are slower than the dot matrix printhead 16, and not suitable for use in high speed printers.

The ribbon cartridge assembly 18 (FIGS. 2 and 3) carries a supply of two different ribbons 30, 40. The lower one-third portion of the cartridge assembly 18 carries an ordinary ribbon 30 which is randomly stuffed in a conventional manner inside a chamber 32. The ribbon 30 is multi-strike ribbon formed of a fabric impregnated with ink. The cartridge assembly 18 includes a pair of arms 34 and 36 (FIG. 1) which support the ribbon 30 so that an active portion thereof moves in a straight line along a path between the printhead 16 and the platen 12 so that the printhead 16 may strike through the ribbon 30 to print on the web 11. Drive wheels 37 and 38 frictionally engage opposite sides of the ribbon 30 to pull it along its path.

The cartridge assembly 18 (FIGS. 2 and 3) also carries a supply of MICR ribbon 40. The MICR ribbon 40, because it is used only once, is carried on a supply reel 42 and wound onto a take-up reel 44. As seen in FIGS. 1 and 3, the supply reel 42 is positioned above and to one side of the take-up reel 44, the two together occupying approximately the upper two-thirds of the cartridge assembly 18.

The MICR ribbon 40 is also guided by arms 34 and 36 (FIG. 1) to travel on a path having an active portion in which the ribbon 40 is held coplanar with, parallel to, and above the active portion of the ribbon 30. The MICR ribbon 40 is pulled along from the supply reel 42 to the take-up reel 44 by a pair of opposed drive wheels 48 and 50 which engage opposite sides of the MICR ribbon 40. The take-up reel 44 is driven by a belt 52 which passes around the shaft 54 on which the wheel 48 is mounted and around a stub shaft 56 connected with the take-up reel 44. Slippage between the belt 52 and the shafts 54 and 56 accommodates the changing rate at which the take-up reel 44 must turn as the amount of ribbon 40 wound thereon increases.

The drive wheel 48 (FIG. 3) is located in vertical alignment with the drive wheel 38. As will become clear from what follows, a single ribbon drive shaft 60 may be used to drive both drive wheels 38 and 48 and thus to pull both ribbons 30 and 40 through the active portion of their respective paths.

Figure 3:
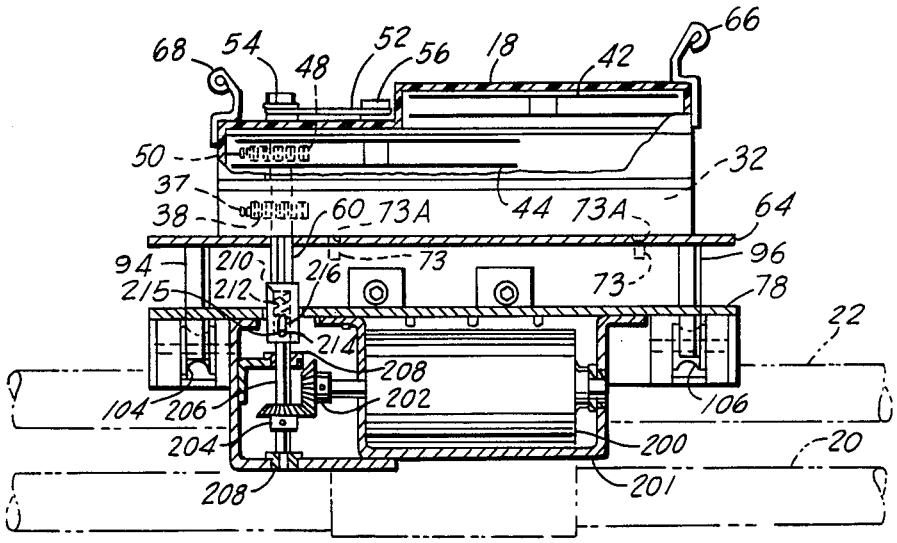
FIG. 3 is a sectional view taken along the line 3—3 of FIG. 2.
Figure 4:
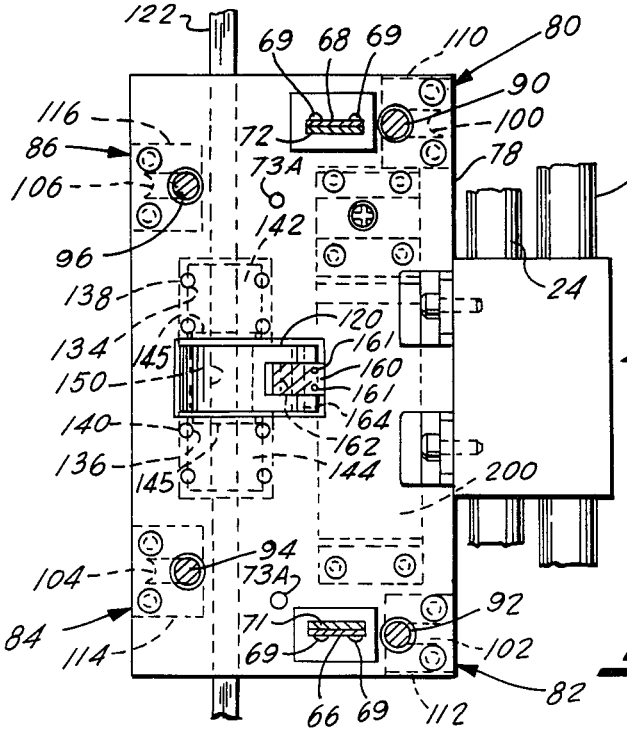
FIG. 4 is a view in the direction of arrows 4—4 of FIG. 2.

The cartridge assembly 18 is secured to a generally planar cartridge mounting plate 64 (FIGS. 2 and 3) by means of spring clips 66 and 68. The spring clips 66 and 68 are secured by means of rivets or suitable screws 69 (FIG. 4) to tabs 71 and 72, respectively, which extend downward from the bottom of cartridge mounting plate 64. The cartridge assembly 18 is provided with locating pins 73 which extend through openings 73A(FIGS. 2 and 3) formed in the appropriate locations in the cartridge mounting plate 64. Together, the locating pins 73, the cooperating openings 73A in the cartridge mounting plate 64, and the spring clips 66 and 68 serve to position the ribbon cartridge assembly 18 accurately on the cartrdige mounting plate 64.

The cartridge mounting plate 64 (FIG. 2) is carried by the carriage assembly 14 and is mounted for straight line movement in a direction normal to a plane which contains the rotational axis of the platen 12 as indicated by arrow 74 and parallel to the common plane of the active portions of ribbons 30 and 40. Movement in the direction of arrow 74 moves the cartridge assembly 18 between a first operating position (shown) in which the active portion of the ribbon 30 is located between the printhead 16 and the platen 12 and a second operating position in which the active portion of the MICR ribbon 40 is located between the printhead 16 and the platen 12. Further, this movement also causes selective engagement of the ribbon drive shaft 60 with the drive-wheel 48 (FIGS. 1 and 3) which pulls the MICR ribbon 40.

The cartridge assembly 18 and cartridge mounting plate 64 are mounted for straight line movement in the direction of arrow 74 with respect to the carriage assembly 14. Specifically, the carriage assembly 14 includes a carriage plate 78 (FIG. 2) which extends parallel to the major plane of the cartridge assembly 18 and to the axis of platen 12. Four linear bearing assemblies 80, 82, 84, and 86 (FIG. 4) connect the carriage plate 78 with the cartridge mounting plate 64 to facilitate smooth straight line movement of the cartridge mounting plate 64 toward and away from the carriage plate 78.

Each of the linear bearing assemblies 80, 82, 84, and 86 includes a straight cylindrical guide rail 90, 92, 94, and 96 whose axes are all parallel to the common plane of the active portions of the ribbons 30 and 40 and normal to the plane of the cartridge mounting plate 64. Each of the guide rails 90, 92, 94, and 96 is fastened to the cartridge mounting plate 64 by suitable means such as a countersunk threaded fastener (one shown at 98 in FIG. 2). Each linear bearing assembly 80–86 also includes a rotatably mounted nylon wheel 100, 102, 104, and 106, respectively. The nylon wheels 100, 102, 104, and 106 are supported by mounting blocks 110, 112, 114, and 116, respectively, which are secured to the carriage plate 78. The wheels 100–106 all rotate about axes parallel with the axis of platen 12 and equally spaced from the plane of carriage plate 78.

Each of the nylon wheels 100–106 is formed with a concave exterior surface contoured to engage approximately one-third of the circumference of the respective guide rail 90, 92, 94, and 96. The wheels 100 and 102 are positioned to engage the respective guide rails 90 and 92 from the side of the guide rail 90, 92 closest to the platen 12. The wheels 104 and 106 are positioned to engage the sides of the guide rails 94 and 96 from the side of those guide rails 94, 96 most distant from the platen 12. Thus the linear bearings 80–86 are constructed and arranged to provide for motion of the cartridge mounting plate 64 to which the rails 90–96 are connected in a direction perpendicular to the plane of the carriage plate 78 to which the nylon wheels 100–106 are connected and to resist movement in any other direction.

Movement of the cartridge assembly 18 (FIG. 2) and cartridge mounting plate 64 between the two operating positions is achieved by means of a crank arm 120 connected with a rotatable square shaft 122 and solenoid assembly 124. The square shaft 122 extends the length of and parallel to the platen 12 and rails 20 and 22 (see FIG. 1) and is mounted at opposite ends in bearings 126 and 128 which are suitably connected with the printer 10. The solenoid assemby 124 is fixed to the frame of the printer 10 at one end portion of the square shaft 122 and upon actuation causes the square shaft 122 to rotate.

The square shaft 122 extends through bearing blocks 134 and 136 (FIG. 4) secured to the underside of the carriage plate 78. The two bearing blocks 134 and 136 (FIG. 4) engage opposite sides of crank arm 120 and serve to position the axis of rotation of square shaft 122 with respect to the carriage plate 78. Each bearing block 134 and 136 has a cylindrical passage 138 and 140, respectively, therethrough coaxial with the square shaft 122. Within each bearing block 134, 136 is a bearing member 142 and 144, respectively, which has a cylindrical outside surface received rotatably within the respective bearing block 134, 136 and a square central passage through which the square shaft 122 extends. The bearing members 142 and 144 are restrained against axial movement by the end walls of the bearing blocks 134, 136 in one direction and by retaining members 145 in the other direction. The fit of the central square passage through each of the bearing members 142, 144 on the square shaft 122 is such that the bearing members 142 and 144 may slide easily along the square shaft 122, yet with limited play in a direction normal to the axis of the square shaft 122.

The crank arm 120 has a square central passage through which the square shaft 122 fits, and the crank arm 120 is positioned between the two bearing blocks 134 and 136. When the carriage plate 78 moves along rails 20 and 22 transverse to the length of the platen 12, the crank arm 120 follows. When the solenoid assembly 124 rotates the square shaft 122, the crank arm 120 also rotates.

The crank arm 120 drives the cartridge mounting plate 64 through a bracket 160 which extends downward from the underside of the cartridge mounting plate 64. The bracket 160 is fastened to the cartridge mounting plate 64. The bracket 160 includes an oval slot 162 in the end portion of the bracket 160 remote from the cartridge mounting plate 64. The slot 162 extends in a direction parallel to the plane of the cartridge mounting plate 64. A pin 164 is press fit through a passage in the distal end portion of crank arm 120, i.e., the end portion of crank arm 120 remote from the axis of the square shaft 122. The pin 164 extends through the oval slot 162 in the bracket 160. When the square shaft 122 rotates the crank arm 120, the pin 164 presses against the walls of the slot 162 lifting or lowering the cartridge mounting plate 64 accordingly.

To achieve rotation of the square shaft 122, the solenoid assembly 124 (FIGS. 1 and 2) includes a solenoid 170 including a plunger 172 which is spring biased by means of spring 174 to an extended position. The solenoid 170 is in effect a motor. It can, of course, be replaced by equivalent motive mechanism, such as a stepper motor, a D.C. motor with limit switches and polarity/direction reversing circuitry, etc. The plunger 172 acts through an arm 176 which is fixedly connected with square shaft 122. The arm 176 and plunger 172 include a slot 176A and pin 176B arranged similar to those used between bracket 160 and crank arm 120 so that when the solenoid 170 is actuated, the plunger 172 withdraws causing the crank arm 176 and square shaft 122 to rotate in a clockwise direction as viewed in FIG. 2. Upon deenergization of the solenoid 170, the plunger 172 extends biased by spring 174 to rotate the square shaft 122 in the opposite direction.

The limit of extension of the plunger 172 is adjusted by means of a threaded screw 180 which extends through a block 182 fastened to the frame 183 of the printer 10. The screw 180 includes a pad 184 on its distal end portion which abuts the end of the solenoid plunger 172. By adjusting the axial position of the screw 180, the limit of travel in one direction of the solenoid plunger 172 may be adjusted. Suitable locking means 181 may be provided so that screw 180 will retain the position to which it has been adjusted.

In addition to the spring 174 which urges the plunger 172 outward and therefore urges the square shaft 122 to rotate in a counterclockwise direction, a spring 190 (FIG. 1) is provided to further bias the square shaft 122 to rotate in a counterclockwise direction. The strength of the spring 190 is selected to counterbalance as nearly as possible the weight of the cartridge assembly 18, cartridge mounting plate 64, bracket 160, and the guide rails 90–96 connected with the cartridge mounting plate 64. By so counterbalancing the weight which must move up and down when the cartridge assembly 18 moves between its two operating positions, the work to be done by the solenoid assembly 124 is reduced and operation therefore accelerated.

As noted previously, the ribbon drive wheels 38 and 48 (FIG. 3) are driven by a common ribbon drive shaft 60. The ribbon drive shaft 60 is driven by an electric motor 200 carried in a suitable bracket 201 secured to the underside of the carriage plate 78. The motor 200 drives a bevel gear 202 which in turn meshes with a bevel gear 204 which is connected with a shaft 206 coaxial with the ribbon drive shaft 60. The shaft 206 is supported by suitable bearings 208. Through the bevel gear arrangement the motor 200 can be conveniently placed with its axis of rotation horizontal while the axis of the ribbon drive shaft 60 is perpendicular thereto, and parallel to the direction of movement of the cartridge assembly 18 when it moves to change the ribbon 30, 40 in the printing position.

The ribbon drive shaft 60 includes a tubular lower end portion including a central cylindrical passage 210 in which the shaft 206 is a sliding fit. A spring 212 acts between an end wall of the passage 210 and an end face of the shaft 206 urging te ribbon drive shaft 60 upward as viewed in FIG. 3 away from the shaft 206. Rotary motion of the shaft 206 is transmitted to the ribbon drive shaft 60 by means of a pin 214 which is press fit through a passage 215 in shaft 206 and extends through a vertically extending slot 216 in the end portion of the ribbon drive shaft 60. The vertical slot 216 in the tubular portion of ribbon drive shaft 60 therefore serves not only to tranmit torque but also to allow a limited axial movement of the ribbon drive shaft 60 with respect to the shaft 206.

Figure 7:
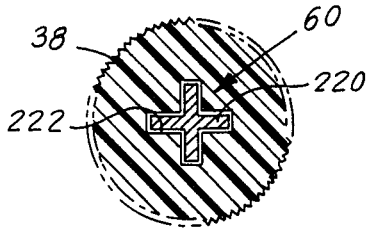
FIG. 7 illustrates a portion of the mechanism shown in FIG. 5B viewed in the direction of arrows 7—7.

The ribbon drive shaft 60 includes a fluted portion 220 (FIGS. 5A and 5B) having an X or cross shaped cross section (FIG. 7) which extends through a correspondingly shaped passage 222 (FIG. 7) through the center of ribbon drive wheel 38. The axial extent of the fluted portion 220 of the ribbon drive shaft 60 is such that when the cartridge assembly 18 moves between operating positions, the torque transmitting surfaces of the ribbon drive shaft 60 are always in contact with the internal surfaces of the passage 222 through the ribbon drive wheel 38.

Figure 5A:
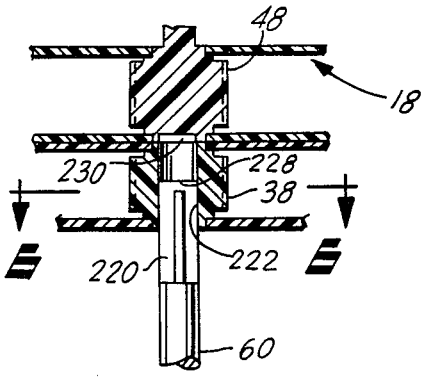
FIGS. 5A and 5B illustrate two operating positions of the mechanism of FIGS. 1–4.
Figure 5B:
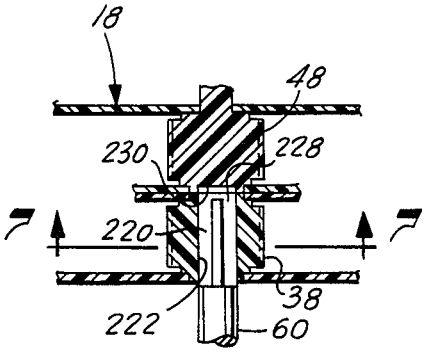
Figure 6:
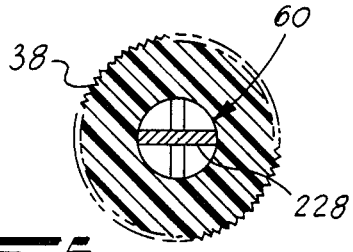
FIG. 6 illustrates a portion of the mechanism shown in FIG. 5A viewed in the direction of arrows 6—6.

The uppermost end portion 228 of the ribbon drive shaft 60 may have the cross section shown in FIG. 6, appearing approximately like a straight bladed screwdriver blade. The upper end portion 228 may also be merely a continuation of the fluted cross section of the lower portion 220. The uppermost end portion 228 of ribbon drive shaft 60 is adapted to be received in a corresonding slot 230 (see FIGS. 5A and 5B) formed in the bottom of drive wheel 48. The slot 230 may be either a single straight slot as shown or it may be two slots positioned at right angles to each other. In any event, when the uppermost end portion 228 is received in the slot 230, it will then transmit torque to the drive wheel 48 to pull the ribbon 40 unwinding it from the supply reel 42 and winding it onto the take-up reel 44.

Figure 2:
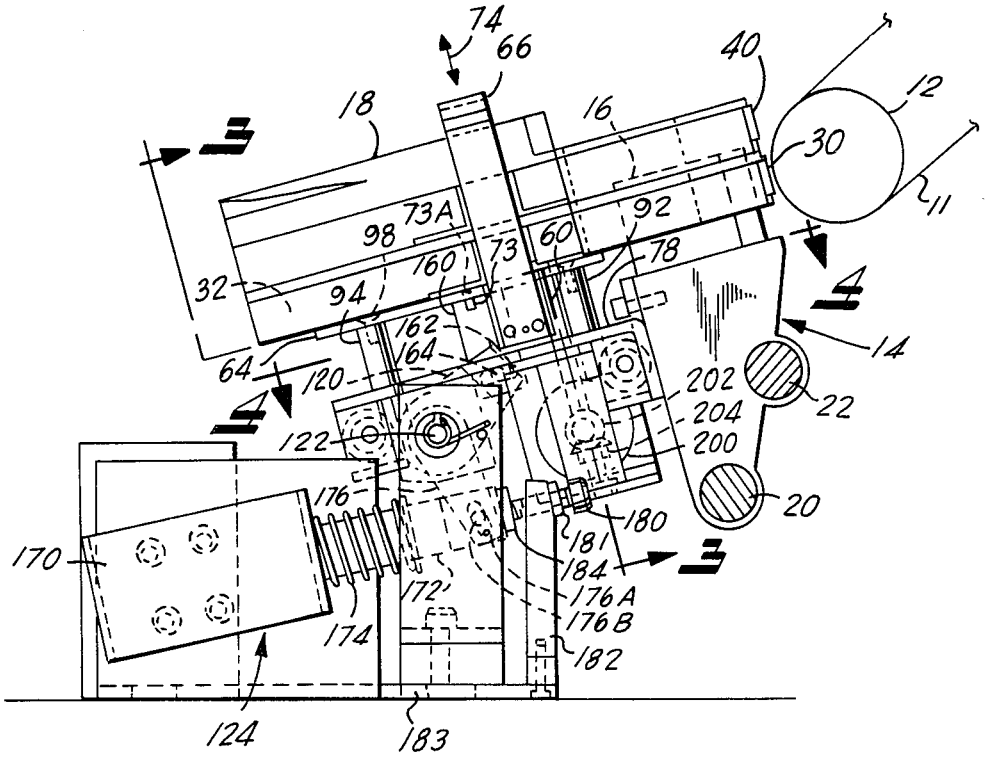
FIG. 2 is an elevation view looking in the direction of arrows 2—2 of FIG. 1.

When the cartridge mounting plate 64 is in its upper operating position as illustrated in FIG. 2, the fluted portion 220 of the ribbon drive shaft 60 is in engagement with the central passage 222 through the ribbon drive wheel 38 which pulls ribbon 30. However, the blade 228 at the top of the ribbon drive shaft 60 is free of engagement with the slot 230 formed in the bottom of MICR ribbon drive gear 48 as shown in FIG. 5A. Accordingly, the ribbon 40 is not driven when the cartridge mounting plate 64 is in the operating position shown in FIG. 2.

When the solenoid assembly 124 is actuated to lower the cartridge mounting plate 64 and to bring the active portion of the MICR ribbon 40 into alignment with the printhead 16 and the platen 12, the ribbon drive shaft 60 automatically engages the slot 230 formed in the bottom of the MICR ribbon drive wheel 48. This occurs because as the cartridge mounting plate 64 is lowered, the drive shaft 60 is not lowered, and the blade 228 at the top of the ribbon drive shaft 60 comes into engagement with the bottom of the ribbon drive wheel 48 as shown in FIG. 5B.

It may happen that as the cartridge 18 moves downward to bring the ribbon drive shaft 60 into engagement with the MICR ribbon drive wheel 48 that the blade 228 at the top of the ribbon drive shaft 60 is not in perfect angular alignment with the slot 230 formed in the ribbon drive wheel 48. When this happens, the bottom of the ribbon drive wheel 48 will contact the upper end of the ribbon drive shaft 60 and press it downward, compressing the spring 212. However, as soon as the motor 200 is actuated, the ribbon drive shaft 60 will rotate, bringing the blade 228 into proper angular alignment with the slot 230, whereupon the spring 212 will cause the ribbon drive shaaft 60 to move upward. The blade 228 will then be in torque transmitting contact with the slot 230 formed in the bottom of the ribbon drive wheel 48. When the solenoid assemby 124 is deactivated, the cartridge assembly 18 moves upward, automatically disengaging the MICR ribbon drive wheel 48 from blade 228.

In operation, power is supplied to the printer 10 through conductor 250 (FIG. 1) and control signals from a data processor 251 are fed to the printer through cable 252. A motor 254 pulls on cable 256 in response to the control signals causing the carriage assembly 14 to reciprocate along the rails 20 and 22. Simultaneously, pins (not shown) in the printhead 16 strike through the active portion of one of the ribbons 30 or 40.

When printing in normal fonts, the dot matrix printhead 16 can form a complete line of characters with a single traverse of the carriage assembly 14 along the axial length of the platen 12, and can do so while moving in either direction. After completion of each line, a motor 258 rotates the platen 12 to advance the web 11 an appropriate distance which depends upon the format of the matter being printed.

When the data processor 251 instructs the printer 10 to print MICR characters, the solenoid assembly 124 is actuated, pulling the cartridge assembly 18 into the second operating position in which the active portion of the MICR ribbon 40 is aligned between the printhead 16 and the platen 12. The carriage assembly 14 is reciprocated by motor 254 as before, except that with MICR characters more than a single traverse of the carriage assembly 14 may be required to completely form the characters. Therefore, when printing MICR characters the platen 12 may not be rotated by motor 258 at the end of every traverse, but instead is rotated only after each line is completely printed.

The software required to actuate and control the platen drive motor 258, the solenoid assembly 124, the ribbon drive motor 200, the carriage drive motor 254, and the printhead 16 is not disclosed herein and does not form a part of the present invention. Moreover, it is believed that production of the necessary software is well within the skill of anyone of ordinary skill in the programming art, and for this further reason need not be set forth herein in detail.

Figure 8:
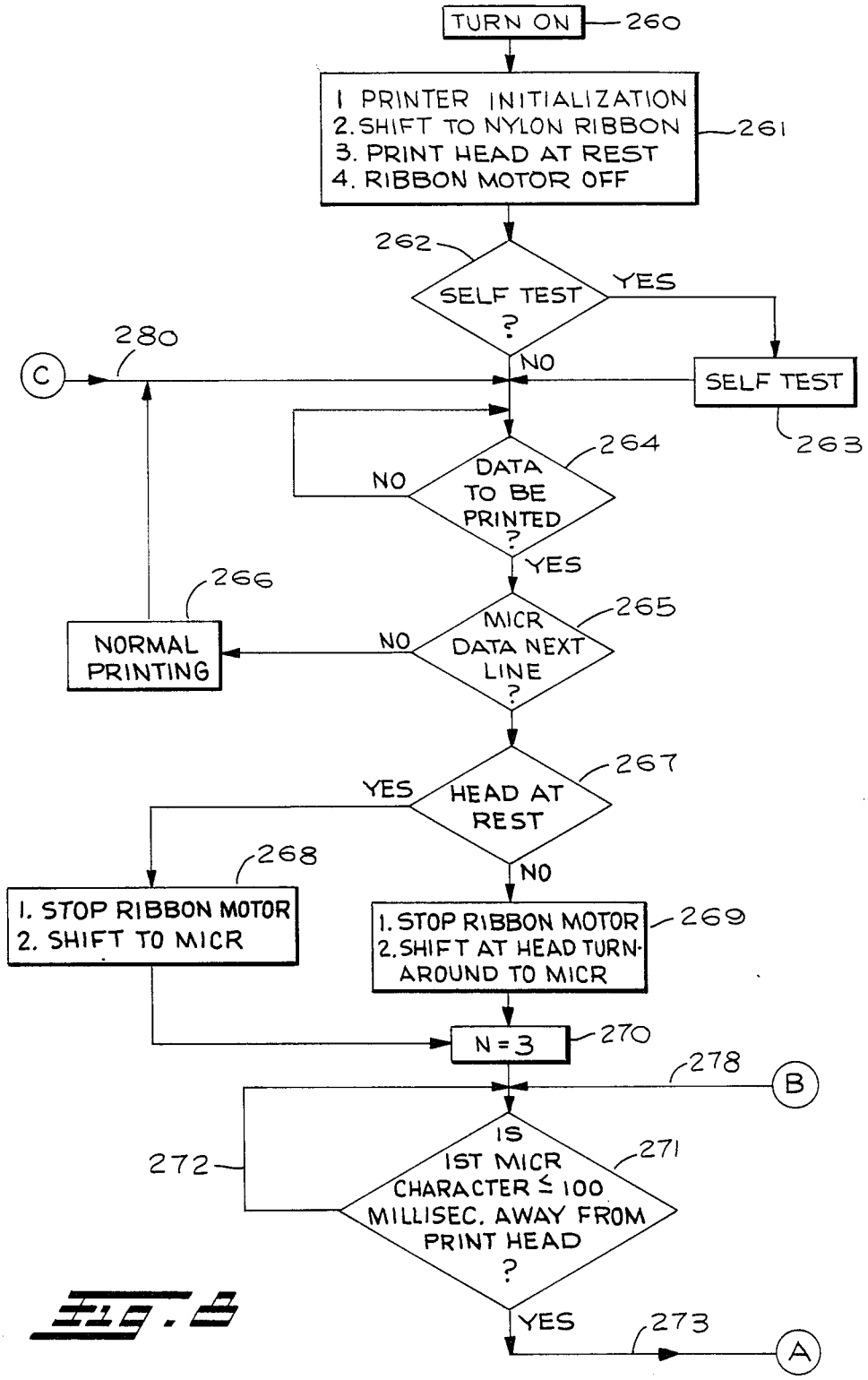
FIGS. 8 and 9 are flow charts indicating operation of the printer in accordance with the present invention with respect to a computer or data processing control/-drive system therefor.
Figure 9:
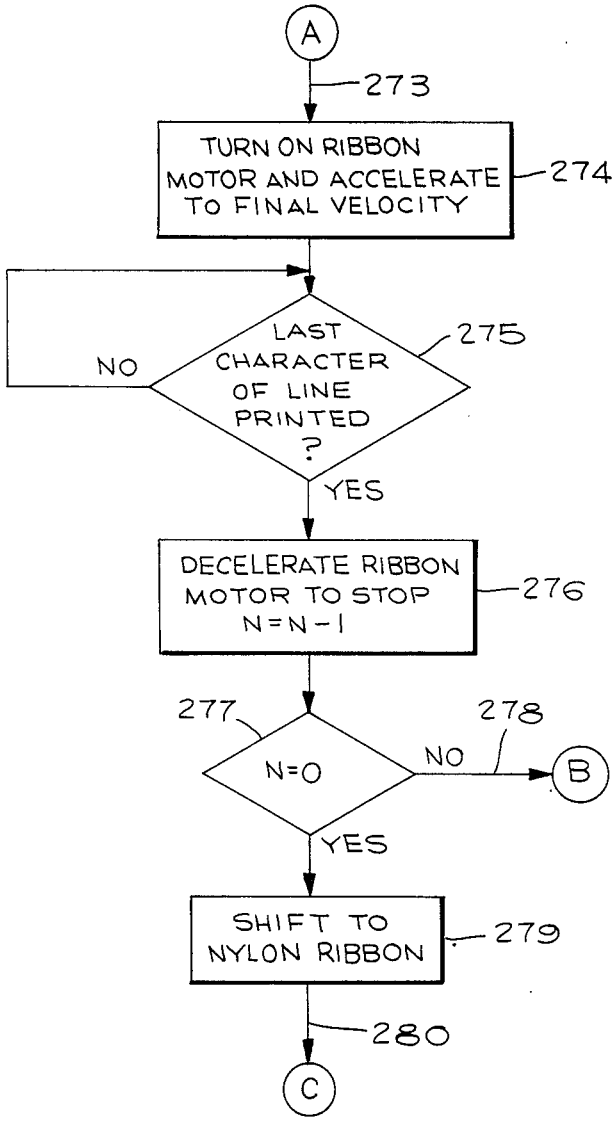

Referring now to FIGS. 8 and 9, computer program flow charts depicting operation of the present invention are illustrated. The flow charts are a shorthand notation representing software that could be used by a conventional computer 251 to drive the printer 10 in accordance with the present invention. A person having ordinary skill in the art would be able to reduce the computer program flow chart to appropriate computer language capable of operating such computer 251 to drive the printer 10 in accordance with the invention. The flow chart represents typical operation of the present invention.

Turning specifically to FIG. 8, in block 260 power is turned on to the printer 10 and computer system. At block 261 conventional initialization routines are run; the nylon ribbon 30, i.e. the non-MICR ribbon 30, is shifted into position ready for use; the printhead 16 is at rest; and the ribbon drive motor 200 is off. At block 262 a self-test inquiry is made. For example, if there is any problem or reason to contemplate the possibility of a problem, then a selftest procedure represented at block 263 would be followed; if not, then at block 264 an inquiry is made whether data is to be printed. When data is to be printed, at block 265 an inquiry is made whether that data is to be MICR data. If negative, then normal printing function using the nylon, i.e. the non-MICR, ribbon 30 is carried out at block 266. Normal printing routine would be the operation of the ribbon motor 200 to drive ribbon 30 through the printer 10 in the usual manner past the printhead 16 as the printhead 16 is printing.

If the inquiry made at block 265 is affirmative, then an inquiry is made at block 267 whether the printhead 16 is at rest. If affirmative, then at block 268 the ribbon motor 200 is stopped and a signal is provided to the solenoid 170 to effect rotation of the square shaft 122 to shift the ribbon cartridge assembly 18 to place the MICR ribbon 40 in alignment with the printhead 16. If the printhead 16 is not at rest, then at block 269 the ribbon motor 200 is stopped, the printhead 16 is shifted to a turn-around location, and the MICR ribbon 40 is also shifted to proper position aligned with the printhead 16. At block 270 a counter value N is made equal to 3 signifying readiness to effect printing using MICR ribbon 40.

At block 271 an inquiry in made whether the first MICR character is less than or equal to 100 milliseconds away from the printhead location. If negative, then a loop is followed according to line 272 until the test is met. When the test is met, then line 273 is followed to block 274 in FIG. 9 turning on the ribbon motor 200 and accelerating the same and the MICR ribbon 40 to final velocity. Printing then is carried out using the printhead 16 and the MICR ribbon 40. At block 275 an inquiry is made whether the last character of a given line has been printed. If negative, then a loop is followed. When affirmative, then at block 276 the ribbon motor 200 is decelerated to stop the same, and the counter value N is decremented. At block 277 an inquiry is made whether the counter N equals zero. If negative, then line 278 is followed back to block 271 in FIG. 8. However, if the counter N is zero at block 277, then at block 279 the nylon or non-MICR ribbon 30 is shifted into alignment with the printhead 16, and line 280 is followed back to block 264 in FIG. 8. The counter N assures that no more than three lines are printed using MICR ribbon 40 unless a separate command is received from the data processor 251. This characteristic saves MICR ribbon 40 from excessive use and can also be relied on to facilitate the printing of an MICR line using the printer 10 in three distinct passes in order to fill in the characters on a single line so that they appear as though printed with a solid type printer as opposed to a dot matrix type.

Using the present invention, then, media, such as checks, can be printed in an extremely convenient fashion. For example, the non-MICR ribbon 30 may be aligned with the printhead 16 selectively as desired, and the printhead 16 used therewith to print portions of the medium with non-MICR ink. At those areas of the medium that MICR characters are desired, when it comes time to print the same using the printhead 16, the MICR ribbon 40 is shifted into appropriate alignment for printing using the dot matrix printer printhead 16.

Most preferably the metod of the invention is carried out for printing bank checks, such as payroll checks and the like. A single supply of blank check forms can be provided to an automatic paper feeder in the printer 10. The printer 10 then can print those portions of the check including the payer, payee, address information, tax information, witholding information, check amount, bank indentification, etc. using the non-MICR ink. The non-MICR ribbon 30 may be used for multiple passes by the printhead 16 without excessive wear. Those portions of the check which require magnetic coded information may be printed using the MICR ribbon 40 and ink. That information may be, for example, a bank identification number, customer account number, and check amount information. It will be appreciated that no further encoding or applying of MICR data to the check would be needed when the check is subsequently processed for payment, for example; thus, that additional labor step, the equipment required therefor, and the possibility of an error being made is eliminated. Importantly, elimination of that error possibility saves the labor having to find an error; such elimination is effected by printing the check amount using regular ink and using MICR ink during essentially a single pass of the check through a single printer 10.

Figure 12:
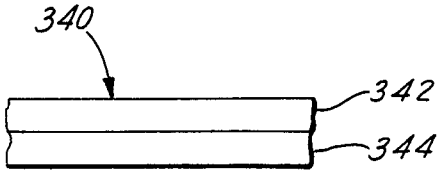
FIG. 12 is a fragmentary view of a ribbon having two bands of different ink.

Although a preferred embodiment of the invention has been described, the scope of the invention is limited only by the claims which follow and not by the specific embodiment disclosed. Among the contemplated variations are the following. Although two ribbons 30, 40 have been described, one being treated with ordinary ink and the other being treated with MICR ink, it is contemplated that the two ribbons 30, 40 could differ only in the color of the ink used. Further, it is possible to utilize the present invention with a single ribbon 340 (FIG. 12) having two parallel bands of ink thereon 342, 344, one of one type and another of another type. The two types could be MICR ink and ordinary ink, or the two types could differ in color, or in some other way. Although the cartridge assembly 18 has been shown as made of two separate plastic pieces it could easily be of unitary construction.

Figure 10:
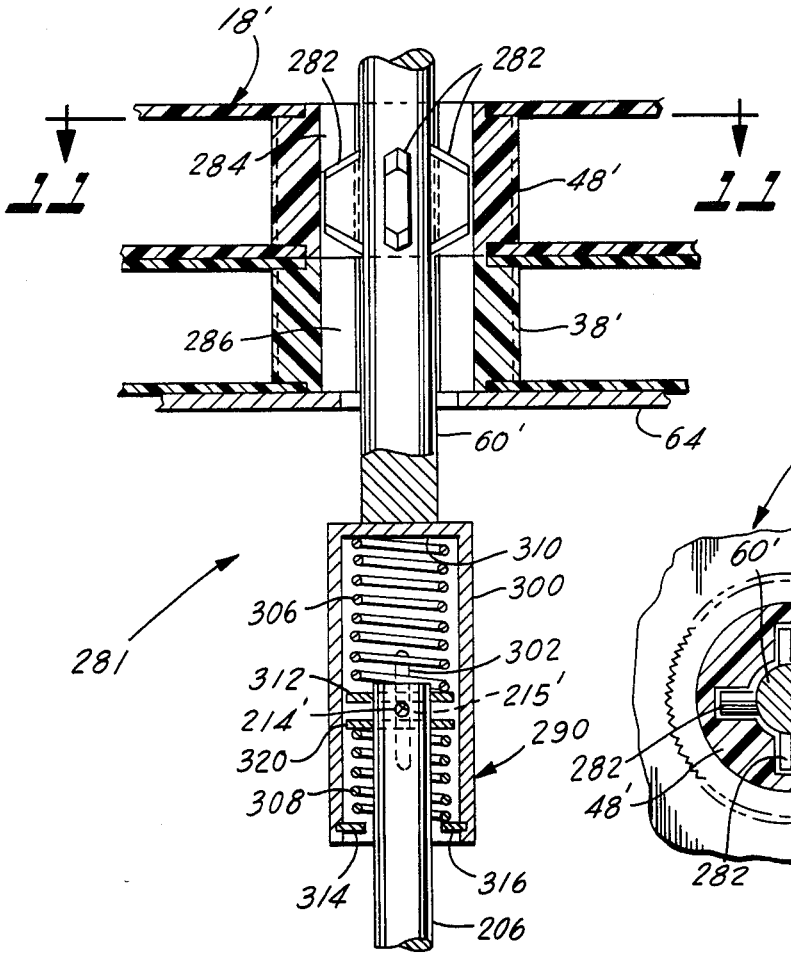
FIG. 10 illustrates another embodiment of the portion of the printer shown in FIGS. 5A–7.
Figure 11:
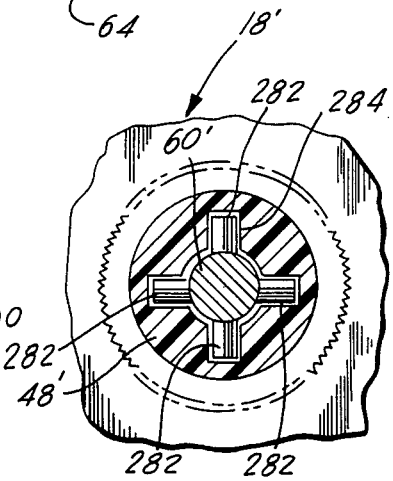
FIG. 11 is a view looking in the direction of arrows 11—11 of FIG. 10.

Additionally, the ribbon drive assembly shown in detail in FIGS. 5A and B and 6 continuously drives one of the ribbons 30 and selectively drives the other ribbon 40. It is contemplated that this mechanism could be replaced with a drive mechanism 281 shown in FIGS. 10 and 11 in which similar numerals are used for similar parts. Where parts vary in detail but their overall function is the same as in the previously described embodiment, a prime (') is appended.

The ribbon drive mechanism 281 drives only one ribbon at a time using the straight line movement of the carriage mounting plate 64 to not only engage the drive of one ribbon but to disengage the drive of the other. The upper ribbon drive wheel 48' is identical to the lower ribbon drive wheel 38', and they are coaxially arranged. The ribbon drive shaft 60' is cylindrical but has four symmetrical blades 282 extending radially outward therefrom. The blades 282 extend axially along the length of shaft 60' a distance less than axial thickness of either drive wheel 38' or 48'. The blades 282 may engage the side walls of a correspondingly shaped passage 284 through drive wheel 48' or the side walls of a correspondingly shaped passage 286 through drive wheel 38'. The blades 282 may be beveled on the axial extreme edges as shown to facilitate engagement with passages 284 and 286.

When the cartridge mounting plate 64 moves between operating positions, the blades 282 move between engagement with the side walls of passage 284 and those of passage 286. The result is that only one ribbon drive wheel, 38' or 48', is driven at one time.

When the cartridge mounting plate 64 moves, the blades 282 must engage one stationary drive wheel (38') while that drive wheel (88') is moving up and the other drive wheel (48') when that drive wheel (38') is moving down with respect to the blades 282. The problem of non-alignment of the passages 284 and 286 is therefore doubled over the previously described embodiment. To accommodate this added difficulty a double acting spring assembly 290 is used to connect ribbon drive shaft 60' with shaft 206.

The spring assembly 290 allows axial movement of the ribbon drive shaft 60' in either direction from a central position. To this end the ribbon drive shaft 60' includes an axial, tubular extension 300 which may be integrally formed with the shaft 60' or permanently connected thereto. A pair of axially extending and diametrically opposed slots 302 are formed in the walls of tubular extension 300 and slidably receive a pin 214' which is press fit through a passage 215' in shaft 206. The pin 214' transmits torque from shaft 206 through the sides of slots 302 to shaft 60' while allowing axial movement of the shafts 206 and 60' relative to one another.

An opposed pair of springs 306 and 308 bias the pin 214' toward the axial center of the slots 302. Spring 306 extends between an end wall 310 of the tubular extension 300 and a washer 312 circumscribing shaft 206 and bearing against pin 214'. One end of spring 308 bears against a resilient retainer ring or circlip 314 received in a circumferential slot 316 in the lower end portion of the tubular extension 300. The opposite end of spring 308 bears against washer 320 which is pressed thereby against pin 214.

When the cartridge mounting plate 64 shifts position, if the blades 282 are not properly aligned one of the springs 306 or 308 compresses, allowing the cartridge assembly 18' to move to the proper position. As shaft 206 starts to turn, blades 282 soon come into proper alignment and the compressed spring 306 of 308 then pushes the shaft 60' so that the blades 282 engage the walls of a corresponding passage 284 or 286.

Additionally, it is contemplated that the present invention could include more than two ribbons 30, 40. For example, the cartridge assembly 18 could be provided with three or more ribbons each with a different type of ink. Along these lines it is specifically contemplated that the cartridge assembly 18 could be provided with three different colored ribbons and a black ribbon so that with appropriate software it would be possible to print multicolored images. In this case a mechanism like the mechanism 281 could be used with the tubular portion 300 and springs 306 and 308 appropriately proportioned.

Thus it is clear that the present invention provides a printer 10 (FIG. 1) which can print selectively with either of two or more ribbons 30, 40 and a ribbon cartridge assembly 18 for use in such a printer 10. The printer 10 includes a conventional dot matrix printhead 16 and a rotatable platen 12. The printhead 16 is mounted on a carriage assembly 14 for reciprocating movement along a path parallel to the axis of the platen 12. The carriage assembly 14 also carries the ribbon cartridge assembly 18 which has a supply of two or more different ribbons 30, 40 an active portion of each of the ribbons 30, 40 being positionable between the printhead 16 and the platen 12 for printing on a web 11 or other sheet material.

The ribbon cartridge assembly 18 may include two ribbon supplies, one a supply of multi-strike ribbon 30 inked with ordinary ink and the other a supply of single-strike ribbon 40 inked with MICR ink. The multi-strike ribbon 30 is randomly stuffed in a cavity 32 in the lower portion of the cartridge assembly 18, and the active portion thereof is pulled past the printhead 16 by a pair of opposed drive wheels 37 and 38 frictionally engaging opposite sides of the ribbon 30.

The single-strike MICR ribbon 40 is supplied wound on a supply reel 42 and is wound onto a separate take-up reel 44 located between the supply reel 42 and the random storage cavity 32. The MICR ribbon 40 is pulled along a path with an active portion immediately above the active portion of the multi-strike ribbon 30. An opposed pair of drive wheels 48 and 50 pulls the MICR ribbon 40. One of the MICR drive wheels (48) is coaxial with one of the multi-strike ribbon drive wheels (38).

A ribbon drive is arranged to drive selectively at least one of the ribbon supplies. In practice, the MICR ribbon 40 is not driven when the printhead 16 is aligned with the active portion of the multi-strike ribbon 30. Instead, the MICR ribbon 40 is driven only when the printhead 16 is aligned with the active portion of the MICR ribbon 40 to print magnetically readable characters. The selective driving of the MICR ribbon 40 prolongs the time between ribbon cartridge changes.

A mechanism is provided for shifting the cartridge assembly 18 between a first operating position in which the active portion of one of the ribbons (30) is aligned between the printhead 16 and the platen 12 and a second operating position in which the active portion of the other ribbon (40) is so aligned. In cartridges having three or more ribbons, a corresponding number of positions are provided. The shifting mechanism provides for straight line movement, as opposed to a rocking or tilting movement, of the cartridge assembly 18 along a straight line path in the common plane of the active portions of the ribbons 30 and 40 and normal to a plane containing the platen axis, and this facilitates the selective drive of the MICR ribbon 40. Specifically, the drive wheel 38 for the multi-strike ribbon 30 is driven by a fluted shaft 60 which extends through the center thereof. The multi-strike ribbon drive wheel 38 is axially slidable along the shaft 60 as the cartridge 18 shifts between operating positions. In one of the operating positions (FIG. 5B) the shaft 60 engages and drives the drive wheel 48 for the MICR ribbon 40 as well as the multi-strike ribbon drive wheel 38. In the other operating position, the shaft is free of contact with the MICR ribbon drive wheel 48 and so does not drive it. In this way movement of the cartridge assembly 18 between operating positions automatically engages and disengages drive to the more expensive and nonreusable MICR ribbon 40.

The arrangement of the components is also designed to minimize the mass which must move when shifting between one operating position and the other and to minimize the mass that reciprocates with the carriage assembly 14 along the length of the platen 12 as each line is printed. The ribbons 30 and 40 are both driven by a single electric motor 200 which is connected to the reciprocating carriage assembly 14. This motor 200 does not move when the cartridge assembly 18 is shifted between operating positions. Instead, the cartridge assembly 18 moves up and down sliding on the ribbon drive shaft 60 which is driven by the electric motor 200. This not only selectively engages and disengages the MICR drive wheel 48 as discussed above, but also allows reduced weight by using only a single motor 200 and promotes faster shifting between operating positions because the motor 200 itself does not move.

The cartridge assembly 18 is shifted between operating positions by a solenoid 170 which is remote from the cartridge assembly 18. The solenoid 170 is fixed to the printer frame 183 and, through a crank arm 176, rotates a square shaft 122. The square shaft 122 in turn operates a second crank arm 120 which is slidable along the shaft 122 as the carriage assembly 14 moves. The cartridge assembly 18 is mounted on linear bearings 80, 82, 84, and 86 in the carriage assembly 14 and moves up and down in a straight line path when the second crank arm 120 is rotated by actuation of the solenoid 170. The remote mounting of solenoid assembly 124 reduces the reciprocating mass of carriage assembly 14 along the rails 20 and 22 with attendant advantages in speed, reduced vibration and longer wear.

The shift mechanism of the invention may be provided as a conversion kit for modifying existing printers to give them the capability of use with multiple ribbons, as aforesaid.

The following is claimed:

1. A cartridge and drive assembly for use with a printer having a frame and an axially reciprocatable print head, the improvement comprising ribbon cartridge means for containing a plurality of bands of inked ribbon, means for supporting a portion of each of said bands of inked ribbon in a common plane, and means for shifting said cartridge means along a straight line path between a first position in which one of said bands of inked ribbon is aligned for printing and a second position in which another of said bands of inked ribbon is aligned for printing, carriage means for supporting said ribbon cartridge means, said carriage means and ribbon cartridge means being movable with said print head, and said means for shifting comprising a shaft fixed against axial movement, rotatably mounted in fixed position relative to said frame, and extending axially parallel to the axis of reciprocation of said print head, motive means for producing a mechanical output to effect shifting, said motive means being mounted fixed to said frame against reciprocation with said carriage means and being coupled to said shaft to rotate said shaft to effect shifting, a crank arm axially slidable along said shaft and fixed against rotation relative to said shaft, and means for connecting the distal end portion of said crank arm with said ribbon cartridge means to effect movement of said ribbon cartridge means along the straight line path upon rotation of said shaft, and said carriage means including means for positioning the axis of said shaft with respect to said carriage and for positioning said crank arm with respect to said carriage.

2. The cartridge and drive assembly of claim 1, wherein said motive means includes a solenoid, and a second crank arm fixedly connected with said shaft, said solenoid being connected with said second crank arm.

3. The cartridge and drive assembly of claim 2, wherein said shaft is polygonal.

4. The cartridge and drive assembly of claim 2 wherein said shaft is square.

5. The cartridge and drive assembly of claim 1 wherein said ribbon cartridge means includes means for containing a plurality of separate ribbons.

6. The cartridge and drive assembly of claim 5 further including means movable with said carriage means for selectively driving said ribbons.

7. The cartridge and drive assembly of claim 6, wherein said means for selectively driving includes a drive wheel associated with each of said ribbons, a motor driven shaft, said motor driven shaft having torque transmitting surface means for engaged surfaces on one of said drive wheels when said cartridge means is in selcted position along said straight line path and wherein said motor driven shaft is axially movable and biased in at least one axial direction to a predetermined axial position.

8. The cartridge and drive assembly of claim 7 wherein said means for selectively driving one of said ribbons includes motor means fixed with respect to said straight line movement of said cartridge means between said operating positions for driving said motor drive shaft.

9. The cartridge and drive assembly of claim 7 wherein one of said ribbons is inked with MICR ink.

* * * * *